US010731460B2

(12) United States Patent
Zuo et al.

(10) Patent No.: US 10,731,460 B2
(45) Date of Patent: Aug. 4, 2020

(54) DETERMINING FORMATION FLUID VARIATION WITH PRESSURE

(71) Applicant: Schlumberger Technology Corporation, Sugar Land, TX (US)

(72) Inventors: Youxiang Zuo, Sugar Land, TX (US); Adriaan Gisolf, Houston, TX (US); Kai Hsu, Sugar Land, TX (US); Li Chen, Houston, TX (US); Beatriz Barbosa, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 725 days.

(21) Appl. No.: 14/263,893

(22) Filed: Apr. 28, 2014

(65) Prior Publication Data

US 2015/0308261 A1 Oct. 29, 2015

(51) Int. Cl.

| | |
|---|---|
| ***G01V 1/40*** | (2006.01) |
| ***G01V 3/18*** | (2006.01) |
| ***G01V 5/04*** | (2006.01) |
| ***G01V 9/00*** | (2006.01) |
| ***E21B 49/08*** | (2006.01) |

(52) U.S. Cl.
CPC ..... *E21B 49/08* (2013.01); *E21B 2049/085* (2013.01)

(58) Field of Classification Search
CPC ..... E21B 49/08; E21B 2049/085
USPC ..... 702/11
See application file for complete search history.

(56) References Cited

U.S. PATENT DOCUMENTS

| | | | | |
|---|---|---|---|---|
| 5,473,939 | A * | 12/1995 | Leder | E21B 23/06 166/264 |
| 6,729,400 | B2 | 5/2004 | Mullins et al. | |
| 6,799,117 | B1 | 9/2004 | Proett et al. | |
| 6,956,204 | B2 | 10/2005 | Dong et al. | |
| 7,028,773 | B2 | 4/2006 | Fujisawa et al. | |
| 7,081,615 | B2 | 7/2006 | Betancourt et al. | |
| 7,216,533 | B2 | 5/2007 | McGregor et al. | |

(Continued)

OTHER PUBLICATIONS

Hsu et al. "Multichannel Oil-Base Mud Contamination Monitoring Using Downhole Optical Spectrometer," SPWLA 49th Annual Logging Symposium, Edinburgh, Scotland, May 25-28, 2008, pp. 1-13.

(Continued)

*Primary Examiner* — Michael P Nghiem
(74) *Attorney, Agent, or Firm* — Trevor G. Grove

(57) ABSTRACT

A downhole tool is operated to pump fluid from a subterranean formation while obtaining fluid property measurements pertaining to the pumped fluid. The downhole tool is in communication with surface equipment located at the wellsite surface. The downhole tool and/or surface equipment is operated to estimate a first linear, exponential, logarithmic, and/or other relationship between compressibility and pressure of the pumped fluid based on the fluid property measurements. The downhole tool and/or surface equipment may also be operated to estimate a second linear, exponential, logarithmic, and/or other relationship between formation volume factor and pressure of the pumped fluid based on the first relationship. The downhole tool and/or surface equipment may also be operated to measure and correct optical density of the pumped fluid based on the first relationship.

12 Claims, 7 Drawing Sheets

(56) References Cited

U.S. PATENT DOCUMENTS 7,243,537 B2 7/2007 Proett et al.
7,280,214 B2 10/2007 DiFoggio et al.
7,526,953 B2 5/2009 Goodwin et al.
7,586,087 B2 9/2009 Dong et al.
7,913,556 B2 3/2011 Hsu et al.
7,920,970 B2 4/2011 Zuo et al.
7,966,273 B2 6/2011 Hegeman et al.
8,024,125 B2 9/2011 Hsu et al.
8,434,356 B2 * 5/2013 Hsu ..... E21B 47/102 166/250.01
8,434,357 B2 5/2013 Hsu et al.
9,651,476 B2 5/2017 Speck et al.
2003/0139916 A1 * 7/2003 Choe ..... E21B 21/001 703/10
2004/0104341 A1 6/2004 Betancourt et al.
2004/0231408 A1 * 11/2004 Shammai ..... E21B 49/10 73/152.27
2005/0182566 A1 8/2005 DiFoggio
2006/0226699 A1 10/2006 Betancourt et al.
2006/0243047 A1 * 11/2006 Terabayashi ..... E21B 49/10 73/152.55
2007/0119244 A1 5/2007 Goodwin et al.
2007/0175273 A1 8/2007 Follini et al.
2007/0256489 A1 * 11/2007 Wu ..... E21B 47/06 73/152.22
2008/0015781 A1 1/2008 Niemeyer et al.
2009/0078036 A1 * 3/2009 Terabayashi ..... E21B 47/10 73/152.55
2009/0165548 A1 * 7/2009 Pop ..... E21B 49/008 73/152.51
2009/0192768 A1 * 7/2009 Zuo ..... G01N 33/2823 703/2
2010/0088076 A1 * 4/2010 Koutsabeloulis ..... E21B 43/00 703/2
2010/0250215 A1 * 9/2010 Kennon ..... G06F 17/5018 703/10
2011/0042070 A1 * 2/2011 Hsu ..... E21B 47/102 166/250.01
2011/0088949 A1 4/2011 Zuo et al.
2011/0284219 A1 11/2011 Pomerantz et al.
2012/0048531 A1 * 3/2012 Marzouk ..... E21B 36/001 166/57
2013/0340518 A1 12/2013 Jones et al.
2014/0121976 A1 * 5/2014 Kischkat ..... E21B 49/082 702/11
2014/0316705 A1 * 10/2014 Zuo ..... G01V 8/10 702/6
2014/0332281 A1 * 11/2014 Hay ..... E21B 49/084 175/59
2014/0360257 A1 * 12/2014 Indo ..... E21B 47/102 73/152.28
2015/0000393 A1 * 1/2015 Hernandez Marti ..... E21B 47/011 73/152.54
2015/0000984 A1 * 1/2015 McDaniel ..... E21B 21/06 175/64
2015/0135814 A1 * 5/2015 Zuo ..... G01N 9/00 73/152.05
2015/0142317 A1 * 5/2015 Zuo ..... E21B 49/088 702/6
2015/0176407 A1 * 6/2015 Indo ..... G01N 21/31 702/6
2015/0211361 A1 * 7/2015 Gisolf ..... E21B 49/08 702/12
2015/0211363 A1 * 7/2015 Pop ..... E21B 49/081 73/152.28
2015/0211983 A1 * 7/2015 Speck ..... G01N 21/1702 73/152.18
2015/0226059 A1 * 8/2015 Zuo ..... G01N 33/2841 73/152.18
2015/0308264 A1 * 10/2015 Zuo ..... G01N 33/2841 702/6
2016/0208600 A1 * 7/2016 Gisolf ..... E21B 47/00

OTHER PUBLICATIONS

Kristensen et al. "Flow Modeling and Comparative Analysis for a New Generation of Wireline Formation Tester Modules," IPTC 17385, International Petroleum Technology Conference, Doha, Qatar, Jan. 20-22, 2014, pp. 1-14.

Zuo et al. "A New Method for OBM Decontamination in Downhole Fluid Analysis," IPTC 16524—6th International Petroleum Technology Conference, Beijing, China, Mar. 26-28, 2013.

* cited by examiner

DETERMINING FORMATION FLUID VARIATION WITH PRESSURE

BACKGROUND OF THE DISCLOSURE

The formation volume factor (FVF) of a reservoir fluid may be utilized in the determination of fluid properties downhole. For example, FVF may be utilized during reserve estimation, material balance equations, production and reservoir simulations, and equations of state tuning, among other examples. However, these and other examples of utilizing FVF may be inaccurate as FVF varies in response to pressure changes downhole.

FVF and other reservoir fluid properties may be determined utilizing a downhole tool operable to obtain optical density (OD) measurements of the reservoir fluid downhole. However, the OD measurements may also be rendered inaccurate in response to pressure changes downhole.

SUMMARY OF THE DISCLOSURE

A person having ordinary skill in the art will readily recognize that the present disclosure introduces one or more methods in which a downhole is operated to pump fluid from a subterranean formation into the downhole tool while obtaining a series of fluid property measurements pertaining to the pumped fluid over a period of time. The downhole tool is in communication with surface equipment located at a wellsite surface associated with the wellbore. At least one of the downhole tool and the surface equipment is then operated to estimate a first relationship between compressibility and pressure of the pumped fluid based on the series of fluid property measurements. At least one of the downhole tool and the surface equipment is then operated to estimate a momentary FVF of the pumped fluid, and then estimate a second relationship between FVF and pressure of the pumped fluid based on the estimated first relationship and the estimated momentary FVF.

The present disclosure also introduces one or more methods in which a downhole tool is operated within a wellbore adjacent a subterranean formation to pump fluid from the subterranean formation into the downhole tool while obtaining a series of fluid property measurements pertaining to the pumped fluid over a period of time. The downhole tool is in communication with surface equipment located at a wellsite surface associated with the wellbore. At least one of the downhole tool and the surface equipment is operated to estimate a first relationship between compressibility and pressure of the pumped fluid based on the series of fluid property measurements. At least one of the downhole tool and the surface equipment is also operated to measure a momentary OD of the pumped fluid. At least one of the downhole tool and the surface equipment is then operated to correct the measured momentary OD based on the estimated first relationship.

The present disclosure also introduces one or more systems and/or other apparatus in which surface equipment is located at a wellsite surface associated with a wellbore extending into a subterranean formation. A downhole tool is operable within the wellbore to communicate with the surface equipment, pump fluid from the subterranean formation into the downhole tool, and obtain a series of fluid property measurements pertaining to the pumped fluid. At least one processor comprised by at least one of the surface equipment and the downhole tool is operable to estimate a first relationship between compressibility and pressure of the pumped fluid based on the series of fluid property measurements. The at least one processor may be further operable to estimate a momentary FVF of the pumped fluid and estimate a second relationship between FVF and pressure of the pumped fluid based on the estimated first relationship and the estimated momentary FVF. The at least one processor may be further operable to measure a momentary OD of the pumped fluid and correct the measured momentary OD based on the estimated first relationship.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
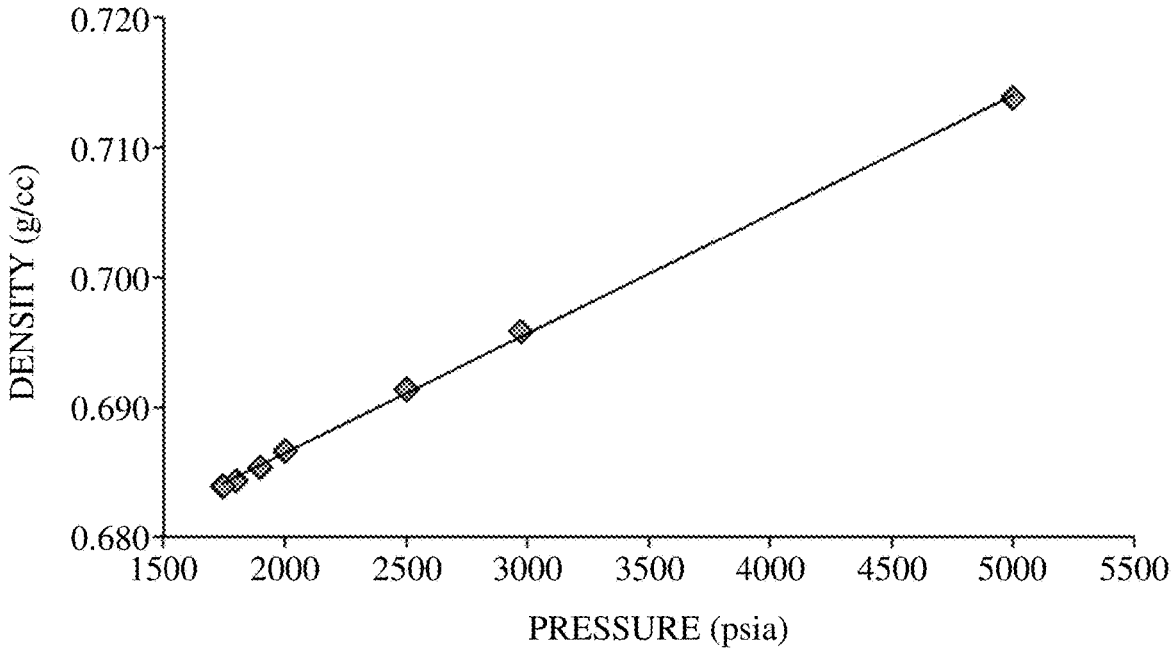
FIG. 1 is a graph demonstrating one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

One or more aspects of the present disclosure pertain to downhole fluid analysis (DFA). For example, one or more aspects of the present disclosure may relate to the determination of FVF of reservoir fluids, pressure-dependent variation of FVF, and/or pressure-based correction of OD utilizing DFA measurements. The expressions set forth below are derived from the definitions of FVF and compressibility of reservoir fluids. Some input parameters in the expressions may be taken directly from the DFA measurements, such as live fluid density and pressure. Other input parameters may be estimated or otherwise determined utilizing the DFA measurements.

One or more aspects of the present disclosure may also be utilized to obtain the pressure dependence of OD, which may be utilized to correct the impact of pressure variations on OD, or to convert OD to a specified (e.g., flowline) pressure. Accordingly, OD values may be updated during pressure changes downhole in real time, such as during the filling of a downhole sample bottle after decontamination pumping has stopped, among other examples. At least one aspect of the present disclosure, therefore, may pertain to correcting the influence that downhole pressure may have on various OD-based answer products, including DFA-based processes for determining composition, gas/oil ratio (GOR), oil-based mud filtrate contamination monitoring, gas/oil/water fraction, and others.

The DFA measurements may be obtained utilizing a fluid in a single-phase at downhole conditions. The phase may be liquid (e.g., oil) or gas (e.g., gas condensate). The fluid may be physically or theoretically flashed from downhole conditions to standard conditions (e.g., 14.7 psia and 60° F.), such as via physical or theoretical volumetric expansion, resulting in flashed liquid (e.g., stock-tank oil (STO)) and flashed gas. For example, before flashing, the temperature ($T_{dh}$) and pressure ($P_{dh}$) of the reservoir fluid may be directly measured downhole and consequently utilized to obtain the volume ($V_{dh}$), density ($\rho_{dh}$), and/or mass ($m_{dh}$). After flashing, the volume ($V_g$), molecular weight ($MW_g$), mass ($m_g$), number of moles ($N_g$), and/or mole ratio ($n_g=N_g/(N_g+N_{sto})$) of the flashed gas at standard conditions may be obtained, and the volume ($V_{sto}$), density ($\rho_{sto}$), molecular weight ($MW_{sto}$), mass ($m_{sto}$), and number of moles ($N_{sto}$) of the STO may be obtained.

The flashed gas is at standard conditions, and thus follows the ideal gas law. Accordingly, the single-stage flash GOR may be expressed as set forth below in Equation (1).

$$GOR = \frac{V_g}{V_{sto}} = \frac{23.69N_g}{\frac{m_{sto}}{\rho_{sto}}} = \frac{23.69\ N_g}{\frac{N_{sto}MW_{sto}}{\rho_{sto}}} = \frac{23.69n_g}{\frac{(1-n_g)\ MW_{sto}}{\rho_{sto}}} = 23.69\frac{n_g}{1-n_g}\frac{\rho_{sto}}{MW_{sto}} \tag{1}$$

It should be noted that 23.69 is the number of liters that one gram-mole of gas occupies at standard conditions to which the ideal gas law is applied.

The FVF for oil ($B_o$) is defined as the ratio of downhole volume to stock-tank liquid (oil) volume, and may be expressed as set forth below in Equation (2).

$$B_o = \frac{V_{dh}}{V_{sto}} = \frac{\frac{m_{dh}}{\rho_{dh}}}{\frac{m_{sto}}{\rho_{sto}}} = \frac{m_{dh}\rho_{sto}}{m_{sto}\rho_{dh}} = \frac{(m_g+m_{sto})\rho_{sto}}{m_{sto}\rho_{dh}} = \left(1+\frac{m_g}{m_{sto}}\right)\frac{\rho_{sto}}{\rho_{dh}} = \left(1+\frac{n_g MW_g}{(1-n_g)MW_{sto}}\right)\frac{\rho_{sto}}{\rho_{dh}} \tag{2}$$

Equation (1) can be re-arranged as set forth below in Equation (3).

$$\frac{n_g}{1-n_g}\frac{1}{MW_{sto}} = \frac{GOR}{23.69\rho_{sto}} \tag{3}$$

Equation (3) may be substituted into Equation (2) to obtain Equation (4) set forth below.

$$B_o = \left(1+\frac{GOR}{23.69}\frac{MW_g}{\rho_{sto}}\right)\frac{\rho_{sto}}{\rho_{dh}} \tag{4}$$

A DFA tool may be operated to measure and/or otherwise obtain GOR, compositions of CO2, C1, C2, C3, C4, C5, and C6+, and live oil density $\rho_{dh}$, thus leaving two unknowns in Equation (4), namely $MW_g$ and $\rho_{sto}$, which may be estimated by various methods. For example, to estimate $MW_g$, one may assume that C6+ is not present in the flashed gas phase, and that CO2 C1, C2, C3, C4, and C5 are not present in the STO, such as may be due to differences in volatility. Consequently, CO2, C1, C2, C3, C4, and C5 expressed in weight-percent ($w_i$) may be converted to mole-percent and subsequently utilized to compute $MW_g$, as set forth below in Equation (5).

$$MW_g = \frac{\Sigma_i w_i}{\Sigma_k \frac{w_k}{MW_k}} \tag{5}$$

An artificial neural network (ANN) may also or instead be utilized to estimate the vapor fractions of C3-C5 and C6+ fractions. Consequently, the C3-C5 and C6+ fractions present in the flashed gas phase may be determined. Accordingly, weight-percent in the flashed gas phase may be converted to mole-percent, such that $MW_g$ may be determined utilizing Equation (5). Such approach may assume that the MW for C6+ is approximately the same as the MW for C6.

An equations-of-state (EOS) method may also or instead be utilized to perform a flash calculation at standard conditions. The results may then be utilized to obtain $MW_g$.

After obtaining MWg, $\rho_{sto}$ remains as the lone unknown in Equation (4). There are several methods by which $\rho_{sto}$ may be obtained. For example, correlations derived from a dead oil database may be utilized to estimate $\rho_{sto}$. An artificial neural network (ANN) may also or instead be utilized to estimate $\rho_{sto}$. An EOS method may also or instead be utilized to perform a flash calculation at standard conditions to obtain $\rho_{sto}$.

The reservoir fluid compressibility (c) may be expressed as set forth below in Equation (6).

$$c = -\frac{1}{V}\left(\frac{\partial V}{\partial P}\right)_T \tag{6}$$

where V is the volume, P is the pressure, and T indicates constant temperature. The reservoir fluid compressibility may also be expressed in terms of density instead of volume, as set forth below in Equation (7).

$$c = \frac{1}{\rho}\left(\frac{\partial \rho}{\partial P}\right)_T = \left(\frac{\partial \ln\rho}{\partial P}\right)_T \tag{7}$$

The reservoir fluid compressibility may also be expressed in terms of formation volume factor, as set forth below in Equation (8).

$$c = -\frac{1}{B_o}\left(\frac{\partial B_o}{\partial P}\right)_T = -\left(\frac{\partial \ln B_o}{\partial P}\right)_T \tag{8}$$

After obtaining compressibility from the volume-pressure curve of Equation (6) and/or the density-pressure curve of Equation (7), the $B_o$ variation with pressure can be obtained by integrating Equation (8), as set forth below in Equation (9).

$$\ln\frac{B_o(P_2)}{B_o(P_1)} = \int_{P1}^{P2} -c(P)\,dP \tag{9}$$

For example, if the oil has a GOR of 713 scf/bbl and an API (American Petroleum Institute) gravity of 42, then the $B_o$ will be 1.475 at a pressure of 1,748 psia and a temperature of 143° F.

FIG. 1 is a graph depicting the example density data varying with pressure. Fitting the data to a relationship yields Equation (10), set forth below. However, relationships other than linear relationships are also within the scope of the present disclosure, including logarithmic relationships, exponential relationships, and others.

$$\rho = 9.186\times10^{-6}P + 0.6681 \tag{10}$$

The derivative of Equation (10) is set forth below as Equation (11).

$$\frac{\partial \rho}{\partial P} = 9.186\times10^{-6} \tag{11}$$

Figure 2:
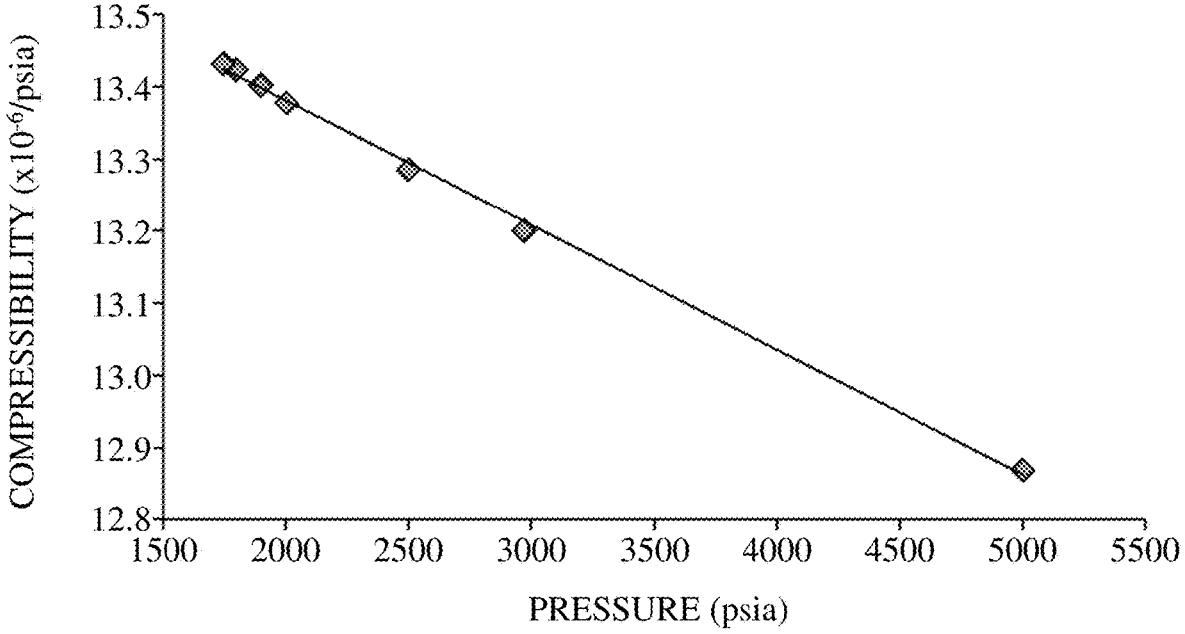
FIG. 2 is a graph demonstrating one or more aspects of the present disclosure.

Accordingly, the compressibility may be estimated by utilizing Equation (7), as set forth below in Equation (12) as graphically depicted in FIG. 2.

$$\ln B_o(P_2) - \ln B_o(P_1) = \int_{P1}^{P2} -c(P)dP = \int_{P1}^{P2} (1.728\times10^{-10}P - 1.373\times10^{-5})dP = \tag{12}$$

-continued $$8.64\times10^{-11}(P_2^2 - P_1^2) - 1.373\times10^{-5}(P_2 - P_1)$$

Figure 3:
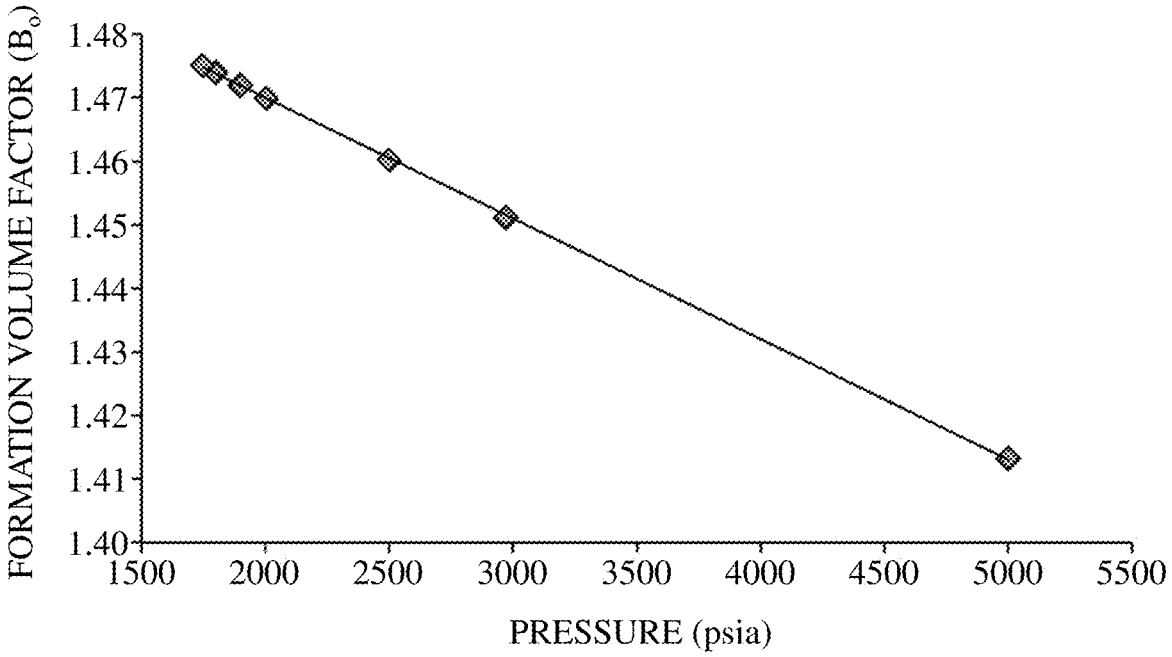
FIG. 3 is a graph demonstrating one or more aspects of the present disclosure.

$B_o$ is 1.475 when pressure is 1,748 psia (bubble point). Therefore, the changes in $B_o$ with respect to pressure are as shown in FIG. 3 and as set forth below in Table 1.

TABLE 1

Example Formation Volume Factor Estimates

| Pressure (psia) | Density (g/cc) | Estimated c ($10^{-6}$/psia) | Estimated $B_o$ |
|---|---|---|---|
| 5000 | 0.714 | 12.87 | 1.413 |
| 2972 | 0.696 | 13.20 | 1.451 |
| 2500 | 0.691 | 13.29 | 1.460 |
| 2003 | 0.687 | 13.38 | 1.470 |
| 1900 | 0.685 | 13.40 | 1.472 |
| 1800 | 0.684 | 13.42 | 1.474 |
| 1748 | 0.684 | 13.43 | 1.475 |

The variation of OD with pressure will now be described. Density is linearly associated with the OD measured by the DFA optical sensor(s). Thus, the fluid compressibility may be expressed as set forth below in Equation (13).

$$c = \frac{1}{OD}\left(\frac{\partial OD}{\partial P}\right)_T = \left[\frac{\partial \ln OD}{\partial P}\right]_T \tag{13}$$

After obtaining compressibility from the volume-pressure curve of Equation (6) and/or the density-pressure curve of Equation (7), the OD changes with pressure may be obtained by integrating Equation (13), as set forth below in Equation (14).

$$\ln\frac{OD(P_2)}{OD(P_1)} = \int_{P1}^{P2} c(P)dP \tag{14}$$

The obtained correlation between OD and pressure may be utilized to correct OD values at different pressures and/or to convert multiple OD values to a specified pressure (e.g., flowline pressure). For example, during decontamination pumping (also known as "cleanup"), pressure may substantially change, such that the pressure during subsequent sample bottle filling (after cleanup) may not be the same as the initial pressure measurements obtained before or during cleanup. Thus, the impact of pressure on OD may be corrected, which may improve the accuracy of OD-based algorithms subsequently utilized to obtain composition, GOR, oil-based mud filtrate contamination, and/or gas/oil/water fraction, among other OD-dependent fluid properties.

The example described above may also be utilized to show how OD changes with pressure. For example, Equation (14) may be integrated to obtain Equation (15) set forth below.

$$\ln OD(P_2) - \ln OD(P_1) = \int_{P1}^{P2} c(P)dP = \int_{P1}^{P2} (-1.728\times10^{-10}P + 1.373\times10^{-5})dP = -8.64\times10^{-11}(P_2^2 - P_1^2) + 1.373\times10^{-5}(P_2 - P_1) \tag{15}$$

Figure 4:
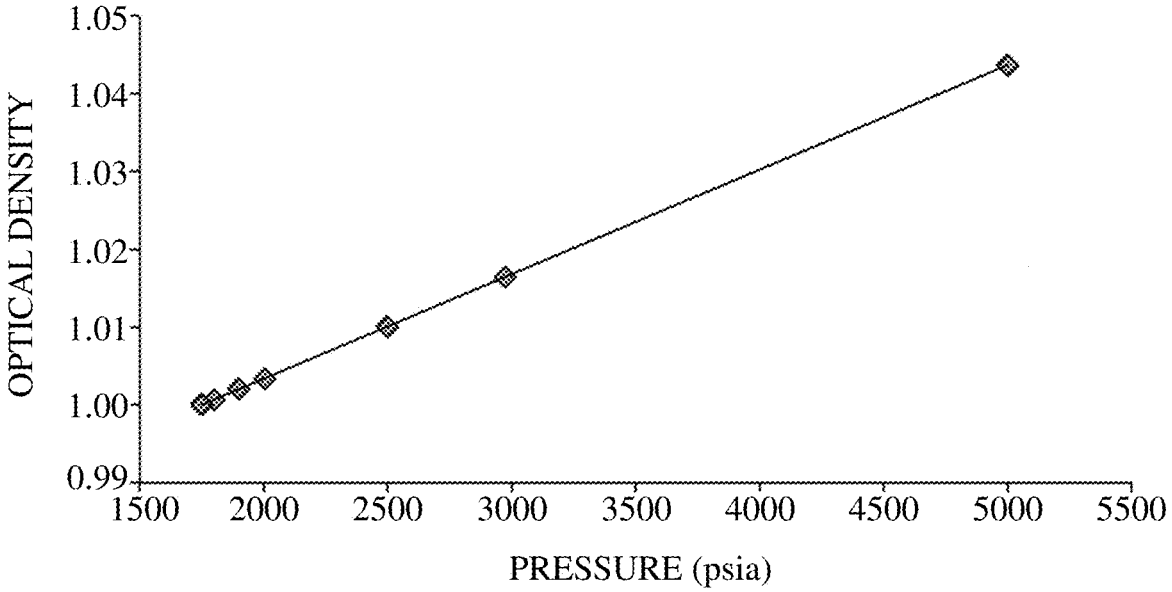
FIG. 4 is a graph demonstrating one or more aspects of the present disclosure.

As above, the OD at a pressure of 1,748 psia (bubble point) is 1.0. Hence, the changes in OD with respect to pressure may be as shown in FIG. 4 and as set forth below in Table 2.

TABLE 2

| Estimated Optical Densities | | | |
|---|---|---|---|
| Pressure (psia) | Density (g/cc) | Estimated c ($10^{-6}$/psia) | Estimated OD |
| 5000 | 0.714 | 12.87 | 1.044 |
| 2972 | 0.696 | 13.20 | 1.016 |
| 2500 | 0.691 | 13.29 | 1.010 |
| 2003 | 0.687 | 13.38 | 1.003 |
| 1900 | 0.685 | 13.40 | 1.002 |
| 1800 | 0.684 | 13.42 | 1.001 |
| 1748 | 0.684 | 13.43 | 1.000 |

Figure 5:
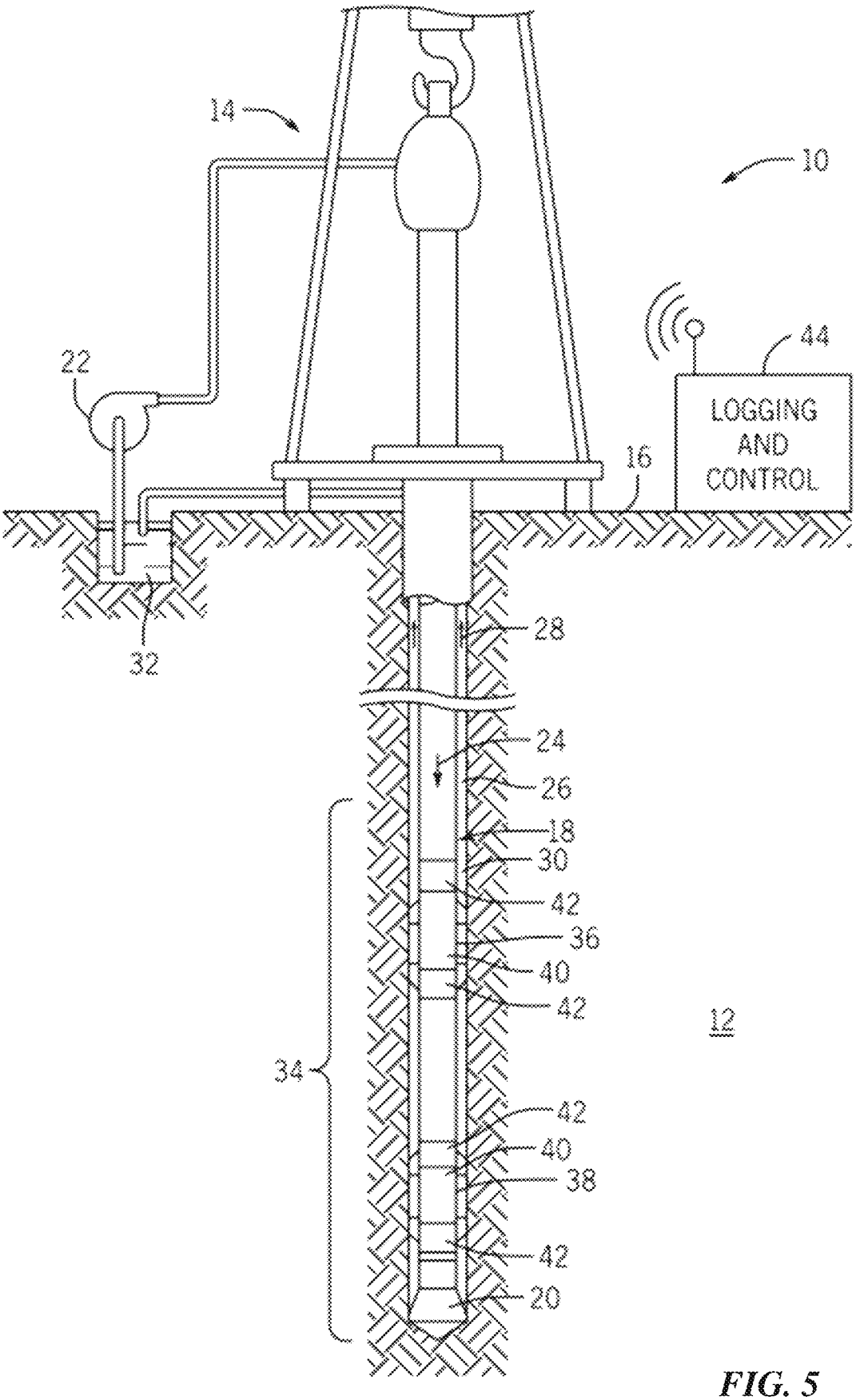
FIG. 5 is a schematic view of at least a portion of apparatus according to one or more aspects of the present disclosure.

FIG. 5 is a schematic view of at least a portion of a drilling system 10 operable to drill a wellbore 26 into one or more subsurface formations 12. A drilling rig 14 at the wellsite surface 16 is operable to rotate a drill string 18 that includes a drill bit 20 at its lower end. As the drill bit 20 is rotated, a pump 22 pumps drilling fluid (commonly referred to as "mud" or "drilling mud") downward through the center of the drill string 18 in the direction of the arrow 24 to the drill bit 20. The mud, which is utilized to cool and lubricate the drill bit 20, exits the drill string 18 through ports (not shown) in the drill bit 20. The mud then carries drill cuttings away from the bottom of the wellbore 26 as it flows back to the wellsite surface 16 through an annulus 30 between the drill string 18 and the formation 12, as shown by the arrows 28. At the wellsite surface 16, the return mud is filtered and conveyed back to a mud pit 32 for reuse.

While a drill string 18 is illustrated in FIG. 5, it will be understood that the embodiments described herein may be applicable or readily adaptable to work strings and wireline tools as well. Work strings may include a length of tubing (e.g., coiled tubing) lowered into the wellbore 26 for conveying well treatments or well servicing equipment. Wireline tools may include formation testing tools suspended from a multi-conductor cable as the cable is lowered into the wellbore 26 to measure formation properties at desired depths. The location and environment of the drilling system 10 may vary widely depending on the formation 12 penetrated by the wellbore 26. Instead of being a surface operation, for example, the wellbore 26 may be formed under water of varying depths, such as on an ocean bottom surface. Certain components of the drilling system 10 may be specially adapted for underwater wells in such instances.

The lower end of the drill string 18 includes a bottom-hole assembly (BHA) 34, which includes the drill bit 20 and a plurality of drill collars 36, 38. The drill collars 36, 38 may include various instruments, such as sample-while-drilling (SWD) tools that include sensors, telemetry equipment, and so forth. For example, the drill collars 36, 38 may include logging-while-drilling (LWD) modules 40 and/or measurement-while drilling (MWD) modules 42. The LWD modules or tools 40 may include tools operable to measure formation parameters and/or fluid properties, such as resistivity, porosity, permeability, sonic velocity, OD, pressure, temperature, and/or others. The MWD modules or tools 42 may include tools operable to measure wellbore trajectory, borehole temperature, borehole pressure, and so forth. The LWD modules 40 may each be housed in one of the drill collars 36, 38, and may each contain one or more logging tools and/or fluid sampling devices. The LWD modules 40 include capabilities for measuring, processing, and/or storing information, as well as for communicating with the MWD modules 42 and/or directly with the surface equipment such as, for example, a logging and control unit 44. That is, the SWD tools (e.g., LWD and MWD modules 40, 42) may be communicatively coupled to the logging and control unit 44 disposed at the wellsite surface 16. In other implementations, portions of the logging and control unit 44 may be integrated with downhole features.

The LWD modules 40 and/or the MWD modules 42 may include a downhole formation fluid sampling tool operable to selectively sample fluid from the formation 12. The drilling system 10 may be operable to determine, estimate, or otherwise obtain various properties associated with the sampled formation fluid. These properties may be determined within or communicated to the logging and control unit 44, such as for subsequent utilization as input to various control functions and/or data logs, including as described above to determine the impact of pressure changes on FVF and/or OD.

Figure 6:
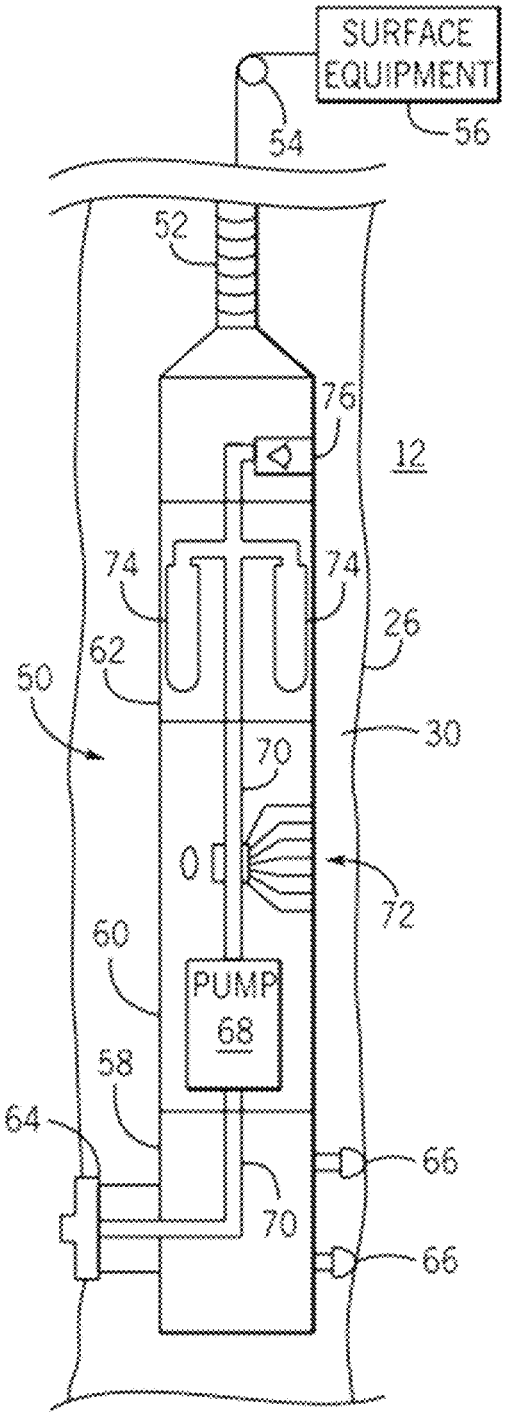
FIG. 6 is a schematic view of at least a portion of apparatus according to one or more aspects of the present disclosure.

FIG. 6 is a schematic diagram of an embodiment of downhole equipment (equipment configured for operation downhole) operable to sample fluid from a formation, such as the formation(s) 12 shown in FIG. 5. Referring to FIGS. 5 and 6, collectively, the downhole equipment includes an example embodiment of a downhole formation fluid sampling tool 50, hereinafter referred to as the downhole tool 50. The downhole tool 50 is conveyable within the wellbore 26 to the subsurface formation 12 and subsequently operable to sample formation fluid from the formation 12. In the illustrated embodiment, the downhole tool 50 is conveyed in the wellbore 26 via a wireline 52. The downhole tool 50 may be suspended in the wellbore 26 from a lower end of the wireline 52, which may be a multi-conductor cable spooled from a winch 54. The wireline 52 may be electrically coupled to wellsite surface equipment 56, such as to communicate various control signals and logging information between the downhole tool 50 and the wellsite surface equipment 56. The wellsite surface equipment 56 shown in FIG. 6 and the logging and control unit 44 shown in FIG. 5, or functions thereof, may be integrated in a single system at the wellsite surface 16.

The downhole tool 50 includes a probe module 58, a pumpout module 60, and a sample module 62, one or more of which may comprise, be part of, or be substantially similar to one or more of the SWD tools, LWD modules 40, and/or MWD modules 42 shown in FIG. 5 and/or described above. However, other arrangements and/or modules may make up the downhole tool 50.

The probe module 58 may comprise an extendable fluid communication line (probe 64) operable to engage the formation 12 and communicate fluid samples from the formation 12 into the downhole tool 50. The probe module 58 may also comprise one or more setting mechanisms 66. The setting mechanisms 66 may include pistons and/or other apparatus operable to improve sealing engagement and thus fluid communication between the formation 12 and the probe 64. The probe module 58 may also comprise one or more packer elements (not shown) that inflate or are otherwise operable to contact an inner wall of the wellbore 26, thereby isolating a section of the wellbore 26 for sampling. The probe module 58 may also comprise electronics, batteries, sensors, and/or hydraulic components used, for example, to operate the probe 64 and the corresponding setting mechanisms 66.

The pumpout module 60 may comprise a pump 68 operable to create a pressure differential that draws the formation fluid in through the probe 64 and pushes the fluid through a flowline 70 of the downhole tool 50. The pump 68 may comprise an electromechanical, hydraulic, and/or other type of pump operable to pump formation fluid from the probe module 58 to the sample module 62 and/or out of the downhole tool 50. The pump 68 may operate as a piston displacement unit (DU) driven by a ball screw coupled to a gearbox and an electric motor, although other types of pumps 68 are also within the scope of the present disclosure. Power may be supplied to the pump 68 via other components located in the pumpout module 60, or via a separate power generation module (not shown). During a sampling period, the pump 68 moves the formation fluid through the flowline 70 toward the sample module 62.

The pumpout module 60 may also include a spectrometer 72 operable to measure characteristics of the formation fluid as it flows through the flowline 70. The spectrometer 72 may be located downstream or upstream of the pump 68. The characteristics sensed by the spectrometer 72 may include OD of the formation fluid. Data collected via the spectrometer 72 may be utilized to control the downhole tool 50. For example, the downhole tool 50 may not operate in a sampling mode until the formation fluid flowing through the flowline 70 exhibits characteristics of a clean formation fluid sample, as detected by or otherwise determined in conjunction with operation of the spectrometer 72. A clean formation fluid sample contains a relatively low level of contaminants (e.g., drilling mud filtrate) that are miscible with the formation fluid when extracted from the formation.

The sample module 62 may comprise one or more sample bottles 74 for collecting samples of the formation fluid. Based on the OD and/or other characteristics of the formation fluid detected via sensors (e.g., the spectrometer 72) along the flowline 70, the downhole tool 50 may be operated in a sampling mode or a continuous pumping (cleanup) mode. When operated in the sampling mode, valves (not shown) disposed at or near entrances of the sample bottles 74 may be positioned to allow the formation fluid to flow into the sample bottles 74. The sample bottles 74 may be filled one at a time, and once a sample bottle 74 is filled, its corresponding valve may be moved to another position to seal the sample bottle 74. When the valves are closed, the downhole tool 50 may operate in a continuous pumping mode.

In the continuous pumping mode, the pump 68 moves the formation fluid into the downhole tool 50 through the probe 64, through the flowline 70, and then out of the downhole tool 50 through an exit port 76. The exit port 76 may be a check valve that releases the formation fluid into the annulus 30 of the wellbore 26. The downhole tool 50 may operate in the continuous pumping mode until the formation fluid flowing through the flowline 70 is determined to be clean enough for sampling. That is, when the formation fluid is first sampled, drilling mud filtrate that has been forced into the formation 12 via the drilling operations may enter the downhole tool 50 along with the sampled formation fluid. After pumping the formation fluid for an amount of time, the formation fluid flowing through the downhole tool 50 will provide a cleaner fluid sample of the formation 12 than would otherwise be available when first drawing fluid in through the probe 64. For example, the formation fluid may be considered clean when the OD data from the spectrometer 72 indicates that the formation fluid contains less than approximately 1%, 5%, or 10% filtrate contamination (by volume), although other values are also within the scope of the present disclosure.

The characteristics of the formation fluid measured by the spectrometer 72 may be useful for performing a variety of evaluation and control functions, in addition to determining when the formation fluid flowing through the flowline 70 is clean enough for sampling. For example, data may be collected from the spectrometer 72 and/or other sensors within the downhole tool, such as a density sensor, a viscosity sensor, a pressure sensor, a temperature sensor, and/or a saturation pressure sensor, among others. The collected data may be utilized to estimate a formation volume factor of the contaminated formation fluid, as well as density, optical density, GOR, compressibility, saturation pressure, viscosity, and/or mass fractions of compositional components of the contaminated formation fluid and/or contaminants therein (e.g., OBM filtrate), among others. The collected data may also be utilized to determine, estimate, or otherwise obtain a dependence of OD and/or FVF on downhole pressure.

Figure 7:
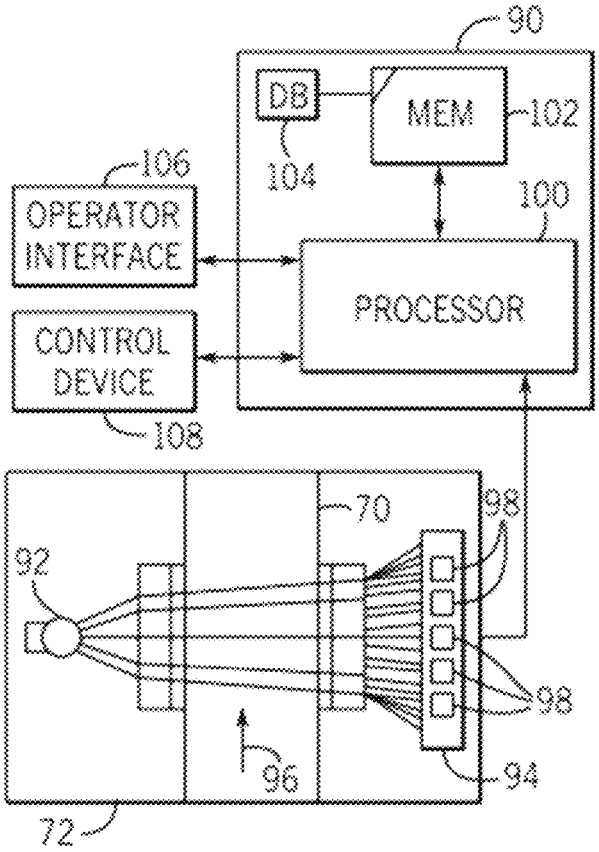
FIG. 7 is an expanded view of a portion of the apparatus shown in FIG. 6.

FIG. 7 is a schematic diagram of the spectrometer 72 and a control/monitoring system 90 may be utilized to estimate or determine such properties. The spectrometer 72 may comprise a light source 92 and a detector 94 disposed on opposite sides of the flowline 70 through which the formation fluid flows, as indicated by arrow 96. The spectrometer 72 may be part of the downhole tool 50, and may be located at various possible locations along the flowline 70 that directs the formation fluid through the downhole tool 50. Although a single light source 92 is depicted in the example shown in FIG. 7, the spectrometer 72 may include additional light sources 92. The detector 94 may sense the light that passes through the formation fluid in the flowline 70.

The detector 94 may include one or more detector elements 98 that may each be operable to measure the amount of light transmitted at a certain wavelength. For example, the detector elements 98 may detect the light transmitted from the visible to near-infrared within a range of 1, 5, 10, 20, or more different wavelengths ranging between about 400 nm and about 2200 nm. However, other numbers of wavelengths (corresponding to the number of detector elements) and other ranges of wavelengths are also within the scope of the present disclosure. For example, optical characteristics of the formation fluid may be detected at a range of wavelengths, such as the near infrared (NIR) wavelength range of approximately 800-2500 nm, 1500-2050 nm, or 1600-1800 nm. Estimations of formation fluid properties according to one or more aspects of the present disclosure may utilize optical data collected at a single wavelength, at multiple wavelengths, a range of wavelengths, and/or multiple ranges of wavelengths.

The spectrometer 72 may measure one or more optical characteristics of the formation fluid flowing through the flowline 70 and output optical spectra and/or other data representative of the detected optical characteristics. The optical characteristics may include OD of the formation fluid at each of the detected wavelengths and/or wavelength ranges. The OD is a logarithmic measurement relating the intensity of light emitted from the light source 92 to the intensity of light detected by the detector 94 at a certain wavelength or range of wavelengths. Each wavelength or wavelength range may correspond to a compositional component of the formation fluid. For example, each wavelength or wavelength range may pertain to a corresponding one of CO2, C1, C2, C3, C4, C5, and C6+, although other arrangements are also within the scope of the present disclosure.

The spectrometer 72 may send optical spectra and/or other data representative of the measured optical characteristics to a processor 100 of the control/monitoring system 90. In the context of the present disclosure, the term "processor" refers to any number of processor components. The processor 100 may include a single processor disposed onboard the downhole tool 50. In other implementations, at least a portion of the processor 100 (e.g., multiple processors collectively operating as the processor 100) may be located within the wellsite surface equipment 56 of FIG. 6, the logging and control unit 44 of FIG. 5, and/or other surface equipment components. The processor 100 may also or instead be or include one or more processors located within the downhole tool 50 and connected to one or more processors located in drilling and/or other equipment disposed at the wellsite surface 16. Moreover, various combinations of processors may be considered part of the processor 100 in the following discussion. Similar terminology is applied with respect to the control/monitoring system 90 as well as a memory 102 of the control/monitoring system 90, meaning that the control/monitoring system 90 may include various processors communicatively coupled to each other and/or various memories at various locations.

The control/monitoring system 90 may estimate the FVF of the reservoir fluid based on the OD data received from the spectrometer 72, a density sensor, a pressure sensor, a temperature sensor, and/or other sensors, and may utilize the estimated FVF—perhaps including the FVF corrected or adjusted for pressure changes—to determine density, OD, GOR, mass fractions of compositional components, and/or other properties of the reservoir fluid. To make these and other determinations, the processor 100 may execute instructions stored in the memory 102.

The processor 100 may be communicatively coupled with one or more operator interfaces 106 and/or control devices 108. The operator interface 106 may include logs of predicted reservoir fluid properties that are accessible to an operator. The control device 108 may include one or more devices and/or portions thereof that receive control signals for operation based on the estimated properties of the reservoir fluid. Such control devices 108 may implement changes in depth of the downhole tool 50 within the wellbore 26, adjustments to the pumping pressure of the pump 68, and/or other control functions, perhaps based on obtained, calculated, and/or estimated reservoir fluid properties.

Figure 8:
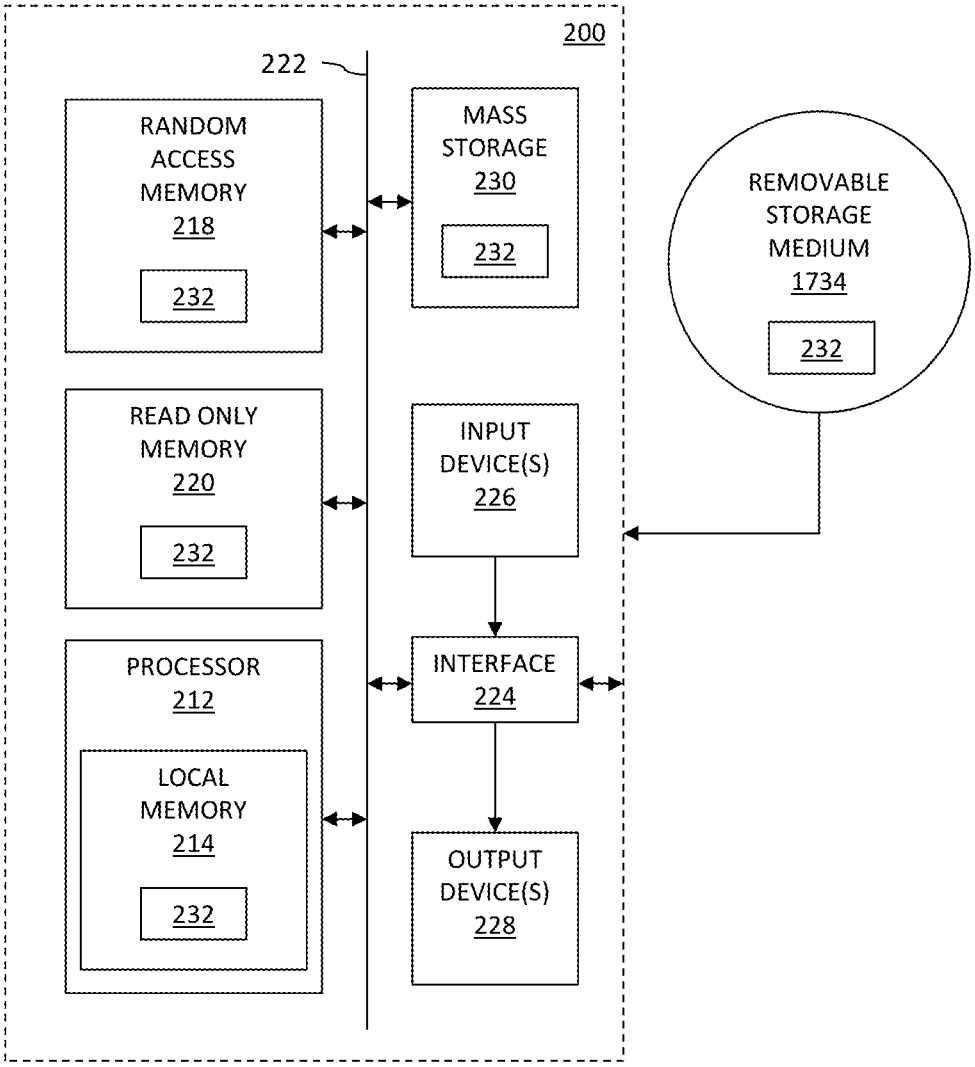
FIG. 8 is a schematic view of at least a portion of apparatus according to one or more aspects of the present disclosure.

FIG. 8 is a block diagram of an example processing system 200 that may execute example machine-readable instructions used to implement one or more of the methods and/or processes described herein, and/or to implement a portion of one or more of the example downhole tools described herein. The processing system 200 may be or comprise, for example, one or more processors, controllers, special-purpose computing devices, servers, personal computers, personal digital assistant (PDA) devices, smartphones, internet appliances, and/or other types of computing devices. Moreover, while it is possible that the entirety of the system 200 shown in FIG. 8 is implemented within a downhole tool, such as the downhole tools and/or modules shown in one or more of FIGS. 5-7, it is also contemplated that one or more components or functions of the system 200 may be implemented in wellsite surface equipment, perhaps including the logging and control unit 44 and/or other wellsite surface equipment depicted in FIG. 5 and/or the wellsite surface equipment 56 shown in FIG. 6.

The system 200 comprises a processor 212 such as, for example, a general-purpose programmable processor. The processor 212 includes a local memory 214, and executes coded instructions 232 present in the local memory 214 and/or in another memory device. The processor 212 may execute, among other things, machine-readable instructions to implement the methods and/or processes described herein. The processor 212 may be, comprise, or be implemented by various types of processing units, such as one or more INTEL microprocessors, microcontrollers from the ARM and/or PICO families of microcontrollers, embedded soft/hard processors in one or more FPGAs, etc. Of course, other processors from other families are also appropriate.

The processor 212 is in communication with a main memory including a volatile (e.g., random-access) memory 218 and a non-volatile (e.g., read-only) memory 220 via a bus 222. The volatile memory 218 may be, comprise, or be implemented by static random access memory (SRAM), synchronous dynamic random access memory (SDRAM), dynamic random access memory (DRAM), RAMBUS dynamic random access memory (RDRAM) and/or other types of random access memory devices. The non-volatile memory 220 may be, comprise, or be implemented by flash memory and/or other types of memory devices. One or more memory controllers (not shown) may control access to the memory 218 and/or 220.

The processing system 200 also includes an interface circuit 224. The interface circuit 224 may be, comprise, or be implemented by various types of standard interfaces, such as an Ethernet interface, a universal serial bus (USB), a third generation input/output (3GIO) interface, a wireless interface, and/or a cellular interface, among others. The interface circuit 224 may also comprise a graphics driver card. The interface circuit 224 may also include a communication device such as a modem or network interface card to facilitate exchange of data with external computers via a network (e.g., Ethernet connection, digital subscriber line (DSL), telephone line, coaxial cable, cellular telephone system, satellite, etc.).

One or more input devices 226 are connected to the interface circuit 224. The input device(s) 226 permit a user to enter data and commands into the processor 212. The input device(s) may be, comprise, or be implemented by, for example, a keyboard, a mouse, a touchscreen, a track-pad, a trackball, an isopoint, and/or a voice recognition system, among others.

One or more output devices 228 are also connected to the interface circuit 224. The output devices 228 may be, comprise, or be implemented by, for example, display devices (e.g., a liquid crystal display or cathode ray tube display (CRT), among others), printers, and/or speakers, among others.

The processing system 200 also includes one or more mass storage devices 230 for storing machine-readable instructions and data. Examples of such mass storage devices 230 include floppy disk drives, hard drive disks, compact disk drives, and digital versatile disk (DVD) drives, among others. The coded instructions 232 may be stored in the mass storage device 230, the volatile memory 218, the non-volatile memory 220, the local memory 214, and/or on a removable storage medium, such as a CD or DVD 234.

As an alternative to implementing the methods and/or apparatus described herein in a system such as the processing system 200 of FIG. 8, methods and or apparatus within the scope of the present disclosure may be embedded in another structure, such as a processor and/or an application-specific integrated circuit (ASIC).

Figure 9:
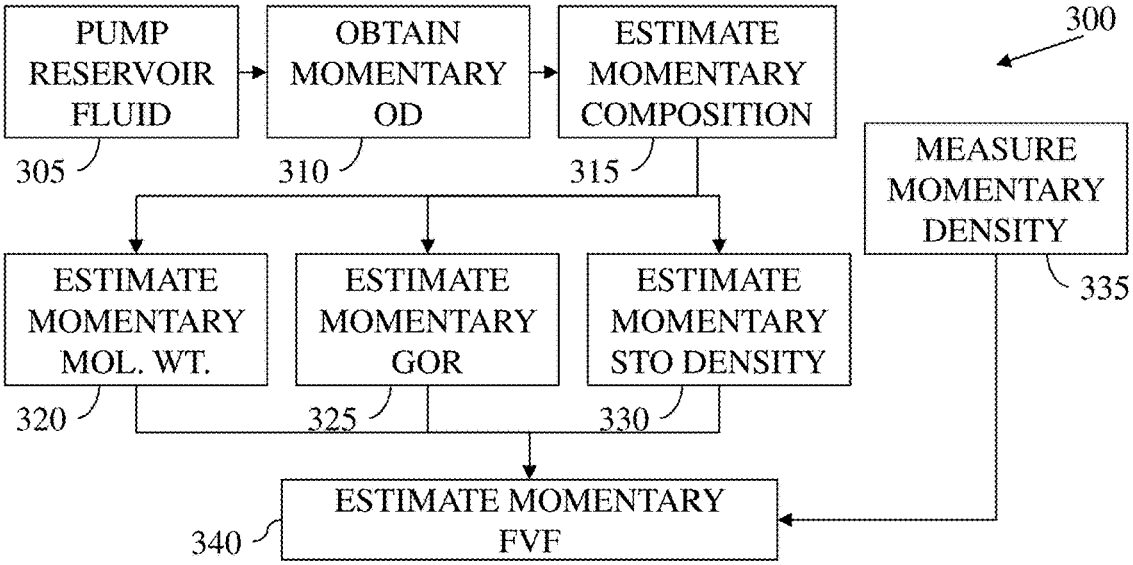
FIG. 9 is a flow-chart diagram of at least a portion of a method according to one or more aspects of the present disclosure.

FIG. 9 is a flow-chart diagram of a method (300) of estimating a momentary FVF of reservoir fluid according to one or more aspects of the present disclosure. One or more aspects of the apparatus shown in one or more of FIGS. 5-8 may be utilized to perform at least a portion of the method (300), although other apparatus may also or instead be utilized to perform at least a portion of the method (300).

The method (300) includes pumping (305) fluid from a reservoir or formation into a downhole tool. The reservoir or formation may be the formation 12 shown in FIG. 5, and the downhole tool may be, comprise, or form at least a portion of one or more of the SWD tools, LWD modules 40, and/or MWD modules 42 shown in FIG. 5, and/or the downhole tool 50 shown in FIGS. 6 and 7. Thus, the downhole tool may be a while-drilling tool or a wireline tool, and may accordingly be operable for conveyance within a wellbore (e.g., wellbore 26 shown in FIG. 5) via drill string or wireline, among other means of conveyance within the scope of the present disclosure. Such conveyance may position the downhole adjacent or otherwise proximate the reservoir or formation under investigation. The downhole tool and/or associated surface equipment (e.g., the logging and control unit 44 shown in FIG. 5 and/or the surface equipment 56 shown in FIG. 6) may include one or more processors operable to perform at least a portion of the method (300). The one or more processors may be, comprise, or form at least a portion of the control/monitoring system 90 shown in FIG. 7 and/or at least a portion of the system 200 shown in FIG. 8.

The method (300) includes measuring or otherwise obtaining (310) the OD of the reservoir fluid pumped into the downhole tool. For example, obtaining (310) the OD may utilize the sensor 72 and/or other features of the apparatus shown in FIGS. 6 and 7.

The OD may be measured or otherwise obtained (310) at a certain moment in time, and may thus be referred to herein as a momentary OD. Such convention also applies to other "momentary" measurements, estimates, and similar items described herein.

A momentary composition of the pumped fluid may then be estimated (315) based at least on the obtained (310) momentary OD. For example, the estimated (315) momentary composition may be or indicate weight, volume, or mole percentages of various compositional components, such as CO2, C1, C2, C3, C4, C5, and/or C6+, although other arrangements are also within the scope of the present disclosure.

A momentary molecular weight of the pumped fluid may then be estimated (320) based at least on the estimated (315) momentary composition. For example, as described above, a theoretical flash may be performed, and the estimated (320) momentary molecular weight may be that of the resulting theoretical gas portion, referred to above as $MW_g$. The momentary molecular weight may be estimated (320) utilizing Equation (5) set forth above, and/or by utilizing an artificial neural network, and/or an EOS method, among other options within the scope of the present disclosure.

A momentary GOR of the pumped fluid may also be estimated (325) based at least on the estimated (315) momentary composition. However, the momentary GOR may also be measured directly via one or more sensors and/or other features of the downhole tool.

A momentary STO density of the pumped fluid may also be estimated (330) based at least on the estimated (315) momentary composition. For example, as described above, a theoretical flash may be performed, and the estimated (330) momentary STO density may be that of the resulting theoretical STO portion, referred to above as $\rho_{sto}$. The momentary STO density may be estimated (330) utilizing one or more correlations derived from a dead oil database, and/or by utilizing an artificial neural network, and/or an EOS method, among other options within the scope of the present disclosure.

The method (300) also includes measuring (335) a momentary density of the pumped fluid. For example, the downhole tool may comprise one or more sensors and/or other features operable to measure density of the pumped fluid. Such density measurement features may be or comprise a vibrating rod density sensor, a vibrating wire density/viscosity sensor, a vibrating fork density sensor, and/or other types of sensors.

A momentary FVF of the pumped fluid may then be estimated (340) based at least on the estimated (320) momentary molecular weight, the estimated (325) momentary GOR, the estimated (330) momentary STO density, and/or the measured (335) momentary density. For example, estimating (340) the momentary FVF of the pumped fluid may comprise utilizing Equation (4) set forth above.

Figure 10:
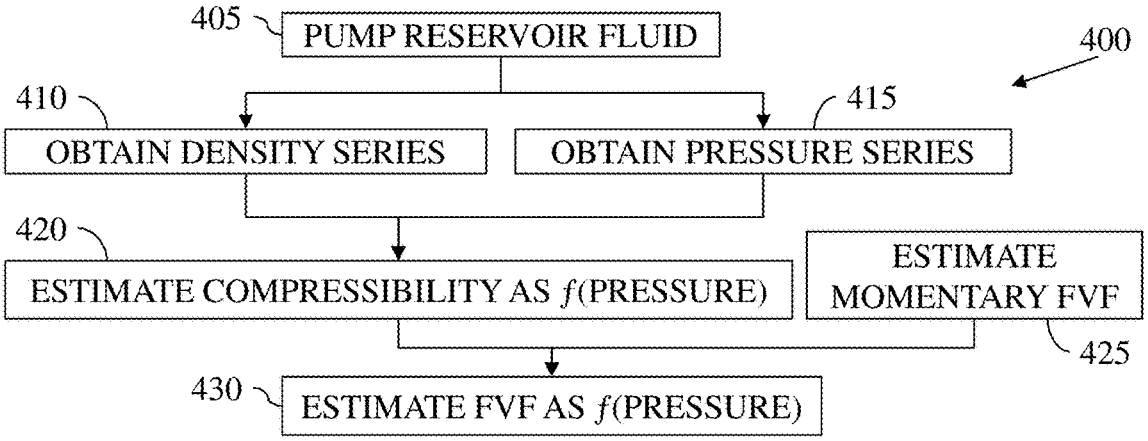
FIG. 10 is a flow-chart diagram of at least a portion of a method according to one or more aspects of the present disclosure.

FIG. 10 is a flow-chart diagram of a method (400) of estimating FVF of reservoir fluid as a function of pressure according to one or more aspects of the present disclosure. One or more aspects of the apparatus shown in one or more of FIGS. 5-8 may be utilized to perform at least a portion of the method (400), although other apparatus may also or instead be utilized to perform at least a portion of the method (400).

The method (400) includes pumping (405) fluid from a reservoir or formation into a downhole tool. The reservoir or formation may be the formation 12 shown in FIG. 5, and the downhole tool may be, comprise, or form at least a portion of one or more of the SWD tools, LWD modules 40, and/or MWD modules 42 shown in FIG. 5, and/or the downhole tool 50 shown in FIGS. 6 and 7. Thus, the downhole tool may be a while-drilling tool or a wireline tool, and may accordingly be operable for conveyance within a wellbore (e.g., wellbore 26 shown in FIG. 5) via drill string or wireline, among other means of conveyance within the scope of the present disclosure. Such conveyance may position the downhole adjacent or otherwise proximate the reservoir or formation under investigation. The downhole tool and/or associated surface equipment (e.g., the logging and control unit 44 shown in FIG. 5 and/or the surface equipment 56 shown in FIG. 6) may include one or more processors operable to perform at least a portion of the method (400). The one or more processors may be, comprise, or form at least a portion of the control/monitoring system 90 shown in FIG. 7 and/or at least a portion of the system 200 shown in FIG. 8.

The method (400) may comprise obtaining (410) a series of density measurements pertaining to the reservoir fluid pumped into the downhole tool. For example, the downhole tool may comprise one or more sensors and/or other features operable to measure the density of the pumped fluid at each of a plurality of times during a specific time period. Such density measurement features may be or comprise a vibrating rod density sensor, a vibrating wire density sensor, a vibrating fork density sensor, and/or other types of sensors.

The method (400) may also or instead comprise obtaining (415) a series of pressure measurements pertaining to the reservoir fluid pumped into the downhole tool. That is, the method (400) may include obtaining (410) the series of density measurements, obtaining (420) the series of pressure measurements, or both. The downhole tool may comprise one or more sensors and/or other features operable to measure the pressure of the pumped fluid at each of a plurality of times during a specific time period. In implementations in which both the series of density measurements are obtained (410) and the series of pressure measurements are obtained (415), the times at which the density measurements are obtained (410) may be the same as the times at which the pressure measurements are obtained (415).

The series of density and/or pressure measurements may then be utilized to estimate (420) compressibility of the pumped fluid as a function of pressure. For example, one or more of Equations (6) and (7) set forth above may be utilized to estimate (420) the compressibility of the pumped fluid as a function of pressure. Estimating (420) the compressibility of the pumped fluid as a function of pressure may include estimating a linear, exponential, logarithmic, and/or other relationship between compressibility and pressure, such as may be similar to the relationship depicted in FIG. 2.

The method (400) may also comprise estimating (425) a momentary FVF of the pumped fluid. For example, estimating (425) the momentary FVF of the pumped fluid may utilize one or more aspects of the method (300) depicted in FIG. 9.

Also, although not shown in FIG. 10, the compressibility of the pumped fluid as a function of pressure may be estimated (420) utilizing the estimated (425) momentary FVF of the pumped fluid. For example, Equation (8) set forth above may be utilized to estimate (420) the compressibility of the pumped fluid as a function of pressure, whether in addition to or instead of utilizing Equations (6) and/or (7) set forth above.

The method (400) also comprises estimating (430) FVF of the pumped fluid as a function of pressure. For example, one or more of Equations (9)-(12) set forth above (although perhaps with different constant values) may be utilized to estimate (430) the FVF of the pumped fluid as a function of pressure. Estimating (430) the FVF of the pumped fluid as a function of pressure may include estimating a linear, exponential, logarithmic, and/or other relationship relationship between FVF and pressure, such as may be similar to the relationship depicted in FIG. 3.

Figure 11:
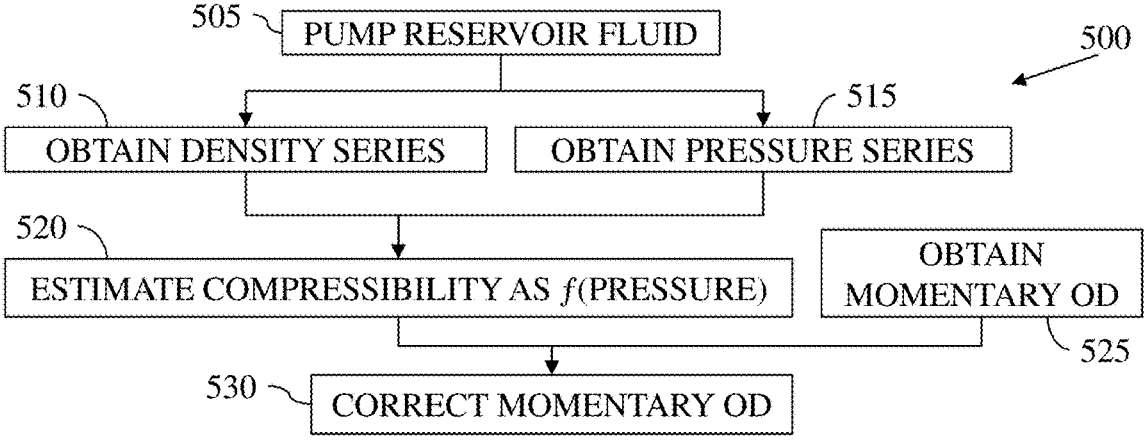
FIG. 11 is a flow-chart diagram of at least a portion of a method according to one or more aspects of the present disclosure.

FIG. 11 is a flow-chart diagram of a method (500) of correcting OD of reservoir fluid based on pressure according to one or more aspects of the present disclosure. One or more aspects of the apparatus shown in one or more of FIGS. 5-8 may be utilized to perform at least a portion of the method (500), although other apparatus may also or instead be utilized to perform at least a portion of the method (500).

The method (500) includes pumping (505) fluid from a reservoir or formation into a downhole tool. The reservoir or formation may be the formation 12 shown in FIG. 5, and the downhole tool may be, comprise, or form at least a portion of one or more of the SWD tools, LWD modules 40, and/or MWD modules 42 shown in FIG. 5, and/or the downhole tool 50 shown in FIGS. 6 and 7. Thus, the downhole tool may be a while-drilling tool or a wireline tool, and may accordingly be operable for conveyance within a wellbore (e.g., wellbore 26 shown in FIG. 5) via drill string or wireline, among other means of conveyance within the scope of the present disclosure. Such conveyance may position the downhole adjacent or otherwise proximate the reservoir or formation under investigation. The downhole tool and/or associated surface equipment (e.g., the logging and control unit 44 shown in FIG. 5 and/or the surface equipment 56 shown in FIG. 6) may include one or more processors operable to perform at least a portion of the method (400). The one or more processors may be, comprise, or form at least a portion of the control/monitoring system 90 shown in FIG. 7 and/or at least a portion of the system 200 shown in FIG. 8.

The method (500) may comprise obtaining (510) a series of density measurements pertaining to the reservoir fluid pumped into the downhole tool. For example, the downhole tool may comprise one or more sensors and/or other features operable to measure the density of the pumped fluid at each of a plurality of times during a specific time period. Such density measurement features may be or comprise a vibrating rod density sensor, a vibrating wire density sensor, a vibrating fork density sensor, and/or other types of sensors.

The method (500) may also or instead comprise obtaining (515) a series of pressure measurements pertaining to the reservoir fluid pumped into the downhole tool. That is, the method (500) may include obtaining (510) the series of density measurements, obtaining (520) the series of pressure measurements, or both. The downhole tool may comprise one or more sensors and/or other features operable to measure the pressure of the pumped fluid at each of a plurality of times during a specific time period. In implementations in which both the series of density measurements are obtained (510) and the series of pressure measurements are obtained (515), the times at which the density measurements are obtained (510) may be the same as the times at which the pressure measurements are obtained (515).

The series of density and/or pressure measurements may then be utilized to estimate (520) compressibility of the pumped fluid as a function of pressure. For example, one or more of Equations (6) and (7) set forth above may be utilized to estimate (520) the compressibility of the pumped fluid as a function of pressure. Estimating (520) the compressibility of the pumped fluid as a function of pressure may include estimating a linear, exponential, logarithmic, and/or other relationship between compressibility and pressure, such as may be similar to the relationship depicted in FIG. 2.

The method (500) may also comprise obtaining (525) a momentary OD of the pumped fluid. For example, obtaining (425) the momentary OD of the pumped fluid may utilize the sensor 72 and/or other aspects of the apparatus shown in FIGS. 6 and 7.

Also, although not shown in FIG. 10, the compressibility of the pumped fluid as a function of pressure may be estimated (520) utilizing a momentary FVF of the pumped fluid, such as the estimated (425) momentary FVF depicted in FIG. 10. For example, Equation (8) set forth above may be utilized to estimate (520) the compressibility of the pumped fluid as a function of pressure, whether in addition to or instead of utilizing Equations (6) and/or (7) set forth above.

The method (400) also comprises correcting (530) the obtained (525) momentary OD of the pumped fluid as a function of pressure. For example, one or more of Equations (13)-(15) set forth above (although perhaps with different constant values) may be utilized to correct (530) the obtained (525) OD of the pumped fluid based on pressure. Correcting (530) the obtained (525) momentary OD of the pumped fluid based on pressure may utilize a linear, exponential, logarithmic, and/or other relationship between OD and pressure, such as may be similar to the relationship depicted in FIG. 4.

Figure 12:
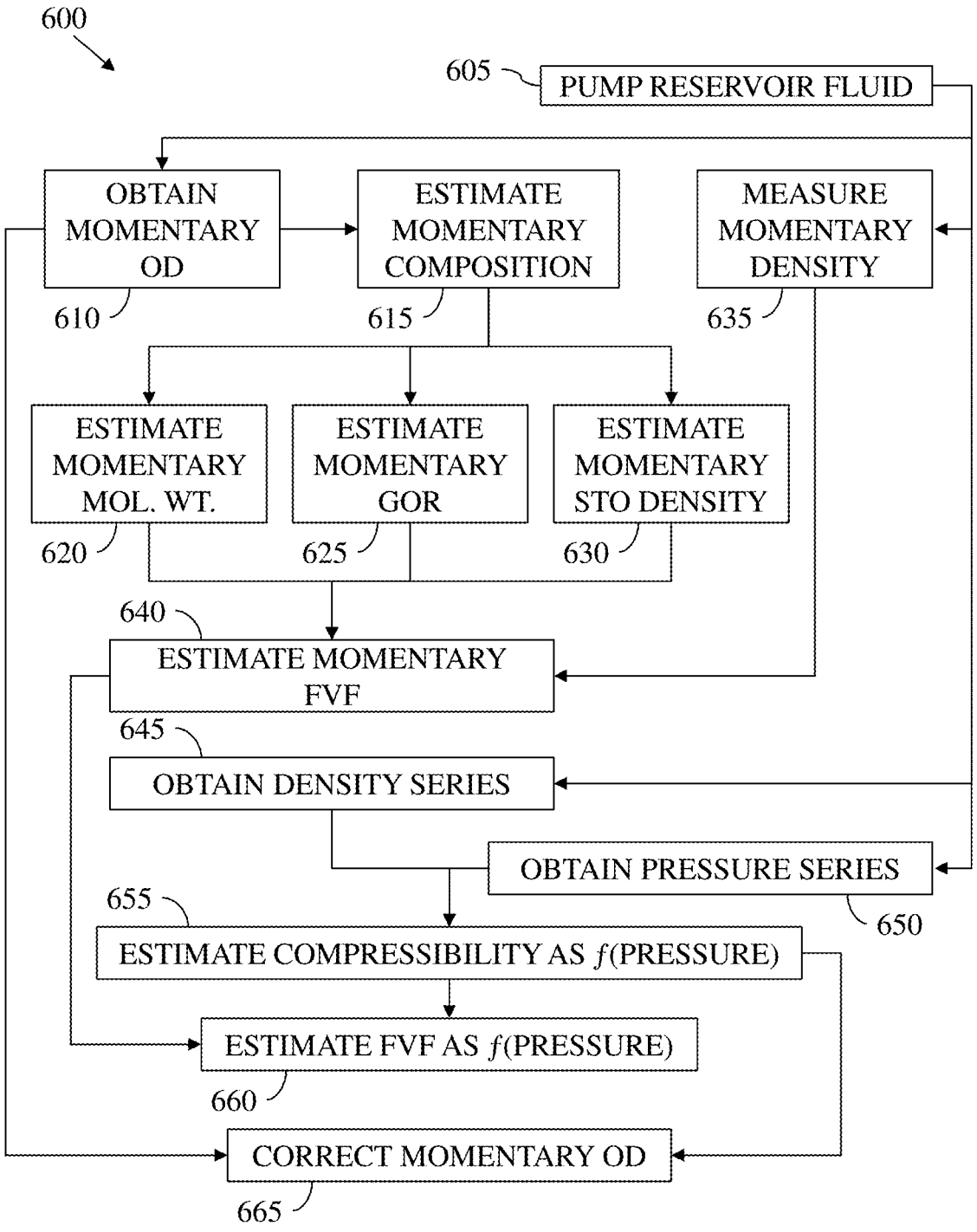
FIG. 12 is a flow-chart diagram of at least a portion of a method according to one or more aspects of the present disclosure.

FIG. 12 is a flow-chart diagram of a method (600) according to one or more aspects of the present disclosure. One or more aspects of the apparatus shown in one or more of FIGS. 5-8 may be utilized to perform at least a portion of the method (600), although other apparatus may also or instead be utilized to perform at least a portion of the method (600).

The method (600) includes pumping (605) fluid from a reservoir or formation into a downhole tool. The reservoir or formation may be the formation 12 shown in FIG. 5, and the downhole tool may be, comprise, or form at least a portion of one or more of the SWD tools, LWD modules 40, and/or MWD modules 42 shown in FIG. 5, and/or the downhole tool 50 shown in FIGS. 6 and 7. Thus, the downhole tool may be a while-drilling tool or a wireline tool, and may accordingly be operable for conveyance within a wellbore (e.g., wellbore 26 shown in FIG. 5) via drill string or wireline, among other means of conveyance within the scope of the present disclosure. Such conveyance may position the downhole adjacent or otherwise proximate the reservoir or formation under investigation. The downhole tool and/or associated surface equipment (e.g., the logging and control unit 44 shown in FIG. 5 and/or the surface equipment 56 shown in FIG. 6) may include one or more processors operable to perform at least a portion of the method (600). The one or more processors may be, comprise, or form at least a portion of the control/monitoring system 90 shown in FIG. 7 and/or at least a portion of the system 200 shown in FIG. 8.

The method (600) includes obtaining (610) a momentary OD of the reservoir fluid pumped into the downhole tool. For example such obtaining (310) may utilize the sensor 72 and/or other features of the apparatus shown in FIGS. 6 and 7.

A momentary composition of the pumped fluid may then be estimated (615) based at least on the obtained (610) momentary OD. For example, the estimated (615) momentary composition may be or indicate weight, volume, or mole percentages of various compositional components, such as CO2, C1, C2, C3, C4, C5, and/or C6+, although other arrangements are also within the scope of the present disclosure.

A momentary molecular weight of the pumped fluid may then be estimated (620) based at least on the estimated (615) momentary composition. For example, as described above, a theoretical flash may be performed, and the estimated (620) momentary molecular weight may be that of the resulting theoretical gas portion, referred to above as $MW_g$. The momentary molecular weight may be estimated (620) utilizing Equation (5) set forth above, and/or by utilizing an artificial neural network, and/or an EOS method, among other options within the scope of the present disclosure.

A momentary GOR of the pumped fluid may also be estimated (625) based at least on the estimated (615) momentary composition. However, the momentary GOR may also be measured directly via one or more sensors and/or other features of the downhole tool.

A momentary STO density of the pumped fluid may also be estimated (630) based at least on the estimated (615) momentary composition. For example, as described above, a theoretical flash may be performed, and the estimated (630) momentary STO density may be that of the resulting theoretical STO portion, referred to above as $\rho_{sto}$. The momentary STO density may be estimated (630) utilizing one or more correlations derived from a dead oil database, and/or by utilizing an artificial neural network, and/or an EOS method, among other options within the scope of the present disclosure.

The method (600) also includes measuring (635) a momentary density of the pumped fluid. For example, the downhole tool may comprise one or more sensors and/or other features operable to measure density of the pumped fluid. Such density measurement features may be or comprise a vibrating rod density sensor, a vibrating wire density sensor, a vibrating fork density sensor, and/or other types of sensors.

A momentary FVF of the pumped fluid may then be estimated (640) based at least on the estimated (620) momentary molecular weight, the estimated (625) momentary GOR, the estimated (630) momentary STO density, and/or the measured (635) momentary density. For example, estimating (640) the momentary FVF of the pumped fluid may comprise utilizing Equation (4) set forth above.

The method (600) may also comprise obtaining (645) a series of density measurements pertaining to the reservoir fluid pumped into the downhole tool. For example, the downhole tool may comprise one or more sensors and/or other features operable to measure the density of the pumped fluid at each of a plurality of times during a specific time period. Such density measurement features may be or comprise a vibrating rod density sensor, a vibrating wire density sensor, a vibrating fork density sensor, and/or other types of sensors, and may be the same as the sensor(s) utilized to measure (635) the momentary density.

The method (600) may also or instead comprise obtaining (650) a series of pressure measurements pertaining to the reservoir fluid pumped into the downhole tool. That is, the method (600) may include obtaining (645) the series of density measurements, obtaining (650) the series of pressure measurements, or both. The downhole tool may comprise one or more sensors and/or other features operable to measure the pressure of the pumped fluid at each of a plurality of times during a specific time period. In implementations in which both the series of density measurements are obtained (645) and the series of pressure measurements are obtained (650), the times at which the density measurements are obtained (645) may be the same as the times at which the pressure measurements are obtained (650).

The series of density and/or pressure measurements may then be utilized to estimate (655) compressibility of the pumped fluid as a function of pressure. For example, one or more of Equations (6) and (7) set forth above may be utilized to estimate (655) the compressibility of the pumped fluid as a function of pressure. Estimating (655) the compressibility of the pumped fluid as a function of pressure may include estimating a linear, exponential, logarithmic, and/or other relationship between compressibility and pressure, such as may be similar to the relationship depicted in FIG. 2.

Also, although not shown in FIG. 12, the compressibility of the pumped fluid as a function of pressure may be estimated (655) utilizing the estimated (640) momentary FVF of the pumped fluid. For example, Equation (8) set forth above may be utilized to estimate (655) the compressibility of the pumped fluid as a function of pressure, whether in addition to or instead of utilizing Equations (6) and/or (7) set forth above.

The method (600) also comprises estimating (660) FVF of the pumped fluid as a function of pressure. For example, one or more of Equations (9)-(12) set forth above (although perhaps with different constant values) may be utilized to estimate (660) the FVF of the pumped fluid as a function of pressure. Estimating (660) the FVF of the pumped fluid as a function of pressure may include estimating a linear, exponential, logarithmic, and/or other relationship between FVF and pressure, such as may be similar to the relationship depicted in FIG. 3.

The method (600) also comprises correcting (665) the obtained (610) momentary OD of the pumped fluid as a function of pressure. For example, one or more of Equations (13)-(15) set forth above (although perhaps with different constant values) may be utilized to correct (665) the obtained (610) OD of the pumped fluid based on pressure. Correcting (665) the obtained (610) momentary OD of the pumped fluid based on pressure may utilize a linear, exponential, logarithmic, and/or other relationship between OD and pressure, such as may be similar to the relationship depicted in FIG. 4.

In view of the entirety of the present disclosure, including the figures, a person having ordinary skill in the art will readily recognize that the present disclosure introduces one or more methods comprising: operating a downhole within a wellbore adjacent a subterranean formation to pump fluid from the subterranean formation into the downhole tool while obtaining a series of fluid property measurements pertaining to the pumped fluid over a period of time, wherein the downhole tool is in communication with surface equipment located at a wellsite surface associated with the wellbore; and operating at least one of the downhole tool and the surface equipment to: estimate a first linear, exponential, logarithmic, and/or other relationship between compressibility and pressure of the pumped fluid based on the series of fluid property measurements; estimate a momentary formation volume factor (FVF) of the pumped fluid; and estimate a second linear, exponential, logarithmic, and/or other relationship between FVF and pressure of the pumped fluid based on the estimated first relationship and the estimated momentary FVF.

The series of fluid property measurements may include a series of density and/or pressure measurements pertaining to the pumped fluid.

The momentary FVF of the pumped fluid may be estimated based on a measured density and optical density (OD) of the pumped fluid at a moment in the period of time. The momentary FVF of the pumped fluid may be estimated based on: a molecular weight of a gas portion of the pumped fluid after flashing, which is estimated based on a composition of the pumped fluid, which is estimated based on the measured OD; a gas-to-oil ratio (GOR) of the pumped fluid, which is estimated based on the estimated composition of the pumped fluid; a density of a stock tank oil (STO) portion of the pumped fluid after flashing, which is estimated based on the composition of the pumped fluid; and the measured density of the pumped fluid.

The method may further comprise conveying the downhole tool within the wellbore via a drill string or wireline.

The present disclosure also introduces one or more methods comprising: operating a downhole tool within a wellbore adjacent a subterranean formation to pump fluid from the subterranean formation into the downhole tool while obtaining a series of fluid property measurements pertaining to the pumped fluid over a period of time, wherein the downhole tool is in communication with surface equipment located at a wellsite surface associated with the wellbore; and operating at least one of the downhole tool and the surface equipment to: estimate a first linear, exponential, logarithmic, and/or other relationship between compressibility and pressure of the pumped fluid based on the series of fluid property measurements; measure a momentary optical density (OD) of the pumped fluid; and correcting the measured momentary OD based on the estimated first relationship.

The series of fluid property measurements may include a series of density and/or pressure measurements pertaining to the pumped fluid.

The method may further comprise conveying the downhole tool within the wellbore via a drill string or wireline.

The present disclosure also introduces one or more systems and/or other apparatus comprising: surface equipment located at a wellsite surface associated with a wellbore extending into a subterranean formation; a downhole tool operable within the wellbore to: communicate with the surface equipment; pump fluid from the subterranean formation into the downhole tool; and obtain a series of fluid property measurements pertaining to the pumped fluid; and at least one processor comprised by at least one of the surface equipment and the downhole tool, wherein the at least one processor is operable to: estimate a first linear, exponential, logarithmic, and/or other relationship between compressibility and pressure of the pumped fluid based on the series of fluid property measurements; estimate a momentary formation volume factor (FVF) of the pumped fluid; estimate a second linear, exponential, logarithmic, and/or other relationship between FVF and pressure of the pumped fluid based on the estimated first relationship and the estimated momentary FVF; measure a momentary optical density (OD) of the pumped fluid; and correcting the measured momentary OD based on the estimated first relationship.

The series of fluid property measurements may include a series of density and/or pressure measurements pertaining to the pumped fluid.

The momentary FVF of the pumped fluid may be estimated based on a measured density and optical density (OD) of the pumped fluid at a moment in the period of time. The momentary FVF of the pumped fluid may be estimated based on: a molecular weight of a gas portion of the pumped fluid after flashing, which is estimated based on a composition of the pumped fluid, which is estimated based on the measured OD; a gas-to-oil ratio (GOR) of the pumped fluid, which is estimated based on the estimated composition of the pumped fluid; a density of a stock tank oil (STO) portion of the pumped fluid after flashing, which is estimated based on the composition of the pumped fluid; and the measured density of the pumped fluid.

The downhole tool may be a while-drilling tool or a wireline tool.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. A method, comprising:

operating a downhole tool within a wellbore adjacent a subterranean formation to pump fluid from the subterranean formation into the downhole tool while obtaining a series of fluid property measurements pertaining to the pumped fluid over a period of time, wherein the downhole tool is in communication with surface equipment located at a wellsite surface associated with the wellbore; and in a processor, estimating:

a compressibility of the pumped fluid based on the series of fluid property measurements;

a first relationship between the compressibility and a pressure of the pumped fluid, the pumped fluid is obtained from the series of fluid property measurements;

a momentary formation volume factor (FVF) of the pumped fluid; and a second relationship between FVF and pressure of the pumped fluid based on the estimated first relationship and the estimated momentary FVF; and in a processor, utilizing the estimated second relationship in a drilling or production operation of the subterranean formation;

wherein the momentary FVF of the pumped fluid is estimated based on a measured density and optical density (OD) of the pumped fluid at a moment in the period of time; and wherein the momentary FVF of the pumped fluid is estimated based on:

a molecular weight of a gas portion of the pumped fluid after flashing estimated based on a composition of the pumped fluid estimated based on the measured OD;

a gas-to-oil ratio (GOR) of the pumped fluid estimated based on the estimated composition of the pumped fluid;

a density of a stock tank oil (STO) portion of the pumped fluid after flashing estimated based on the composition of the pumped fluid; and the measured density of the pumped fluid.

2. The method of claim 1 wherein the series of fluid property measurements includes a series of density measurements pertaining to the pumped fluid.

3. The method of claim 1 wherein the series of fluid property measurements includes a series of pressure measurements pertaining to the pumped fluid.

4. The method of claim 1 wherein the series of fluid property measurements includes a series of density and pressure measurements pertaining to the pumped fluid.

5. The method of claim 1 further comprising, before operating the downhole tool, conveying the downhole tool within the wellbore via drill string or wireline.

6. The method of claim 1 wherein the first and second relationships are each selected from the group consisting of:

a linear relationship;

an exponential relationship; and a logarithmic relationship.

7. A system, comprising:

surface equipment located at a wellsite surface associated with a wellbore extending into a subterranean formation;

a downhole tool operable within the wellbore to:

communicate with the surface equipment;

pump fluid from the subterranean formation into the downhole tool; and obtain a series of fluid property measurements pertaining to the pumped fluid; and at least one processor comprised by at least one of the surface equipment and the downhole tool, wherein the at least one processor is operable to:

estimate a compressibility of the pumped fluid based on the series of fluid property measurements;

estimate a first relationship between the compressibility and a pressure of the pumped fluid, the pumped fluid is obtained from the series of fluid property measurements;

estimate a momentary formation volume factor (FVF) of the pumped fluid;

estimate a second relationship between FVF and pressure of the pumped fluid based on the estimated first relationship and the estimated momentary FVF;

measure a momentary optical density (OD) of the pumped fluid;

correct the measured momentary OD based on the estimated first relationship; and utilize the corrected momentary OD in a drilling or production operation of the subterranean formation.

8. The system of claim 7 wherein the series of fluid property measurements includes a series of density and/or pressure measurements pertaining to the pumped fluid.

9. The system of claim 7 wherein the momentary FVF of the pumped fluid is estimated based on a measured density and optical density (OD) of the pumped fluid at a moment in a period of time.

10. The system of claim 9 wherein the momentary FVF of the pumped fluid is estimated based on:

a molecular weight of a gas portion of the pumped fluid after flashing estimated based on a composition of the pumped fluid estimated based on the measured OD;

a gas-to-oil ratio (GOR) of the pumped fluid estimated based on the estimated composition of the pumped fluid;

a density of a stock tank oil (STO) portion of the pumped fluid after flashing estimated based on the composition of the pumped fluid; and the measured density of the pumped fluid.

11. The system of claim 7 wherein the downhole tool is selected from the group consisting of:

a while-drilling tool; and a wireline tool.

12. The system of claim 7 wherein the first and second relationships are each selected from the group consisting of:

a linear relationship;

an exponential relationship; and a logarithmic relationship.

* * * * *